US006554254B2

(12) United States Patent
Vetesnik

(10) Patent No.: US 6,554,254 B2
(45) Date of Patent: Apr. 29, 2003

(54) HOIST WITH CURVED FRAME MEMBERS

(75) Inventor: Jan Vetesnik, Lorette (CA)

(73) Assignee: Unique Concepts Ltd., Manitoba (CA)

( * ) Notice: Subject to any disclaimer, the term of this patent is extended or adjusted under 35 U.S.C. 154(b) by 0 days.

(21) Appl. No.: 09/882,266

(22) Filed: Jun. 18, 2001

(65) Prior Publication Data

US 2003/0006403 A1 Jan. 9, 2003

(51) Int. Cl.[7] ..... B66F 11/00

(52) U.S. Cl. ..... 254/325; 254/326; 254/334; 254/335

(58) Field of Search ..... 254/325, 326, 254/324, 334, 335; 414/462

(56) References Cited

U.S. PATENT DOCUMENTS

| | | | | | |
|---|---|---|---|---|---|
| 381,256 | A | * | 4/1888 | Lane | 254/326 |
| 451,852 | A | * | 5/1891 | De Castilho | 254/334 |
| 986,399 | A | * | 3/1911 | Lundin | 254/335 |
| 1,266,569 | A | * | 5/1918 | Eggleston | 254/325 |
| 1,354,501 | A | * | 10/1920 | Manley | 254/326 |
| 1,422,459 | A | * | 7/1922 | Manley | 254/326 |
| 1,435,065 | A | * | 11/1922 | Holmes | 254/325 |
| 1,551,132 | A | * | 8/1925 | Butler | 254/325 |
| 1,887,965 | A | * | 11/1932 | Stoner | 254/326 |
| 1,978,999 | A | * | 10/1934 | Jones | 254/334 |
| 2,382,054 | A | * | 8/1945 | Hercik | 254/324 |
| 3,794,296 | A | * | 2/1974 | Hasstedt | 254/335 |
| 3,825,132 | A | * | 7/1974 | Colangelo | 254/326 |
| 3,843,093 | A | * | 10/1974 | Thompson et al. | 254/325 |
| 4,019,716 | A | * | 4/1977 | Smith | 254/334 |
| 5,918,861 | A | * | 7/1999 | Parker | 254/326 |
| 6,050,548 | A | * | 4/2000 | Leger | 254/326 |
| 6,059,266 | A | * | 5/2000 | Ascherin et al. | 254/334 |
| 6,193,218 | B1 | * | 2/2001 | Philyaw | 254/326 |

FOREIGN PATENT DOCUMENTS

| | | | | | |
|---|---|---|---|---|---|
| GB | 2038774 | A | * | 7/1980 | 254/325 |

* cited by examiner

*Primary Examiner*—Kathy Matecki
*Assistant Examiner*—Sang Kim

(57) ABSTRACT

A portable hoist primarily for mounting on the ground at a manhole or similar location for lifting a load such as a person entering the manhole includes a base with a generally Y-shape defining a rear leg and two diverging front legs for mounting on the ground with the front legs either side of the hole. A jib portion is mounted on a vertical post portion of the base and extends upwardly and forwardly therefrom to a cable guide at an upper end overlying the hole. The jib portion is formed by a tubular body extending substantially from the bottom end at the base to the upper end which is smoothly curved with a constant radius of curvature. The body is formed in two parts with one siding inside the other and of the same curvature. Each part has a straight end portion where it attaches to the base and the cable guide respectively. A winch mounting for a winch for the cable is attached to the lower portion at its upper end. The front legs are also formed similarly as two inter-fitting curved parts. A transport bracket for the hitch of a vehicles is provided for mounting the base and the jib portion when separated, with the jib portion standing on a post and the base hanging from a receptacle with the front legs depending in a plane parallel to the jib portion. The curved jib and legs can be manufactured simply and cheaply from limited parts in aluminum with limited welding.

21 Claims, 3 Drawing Sheets

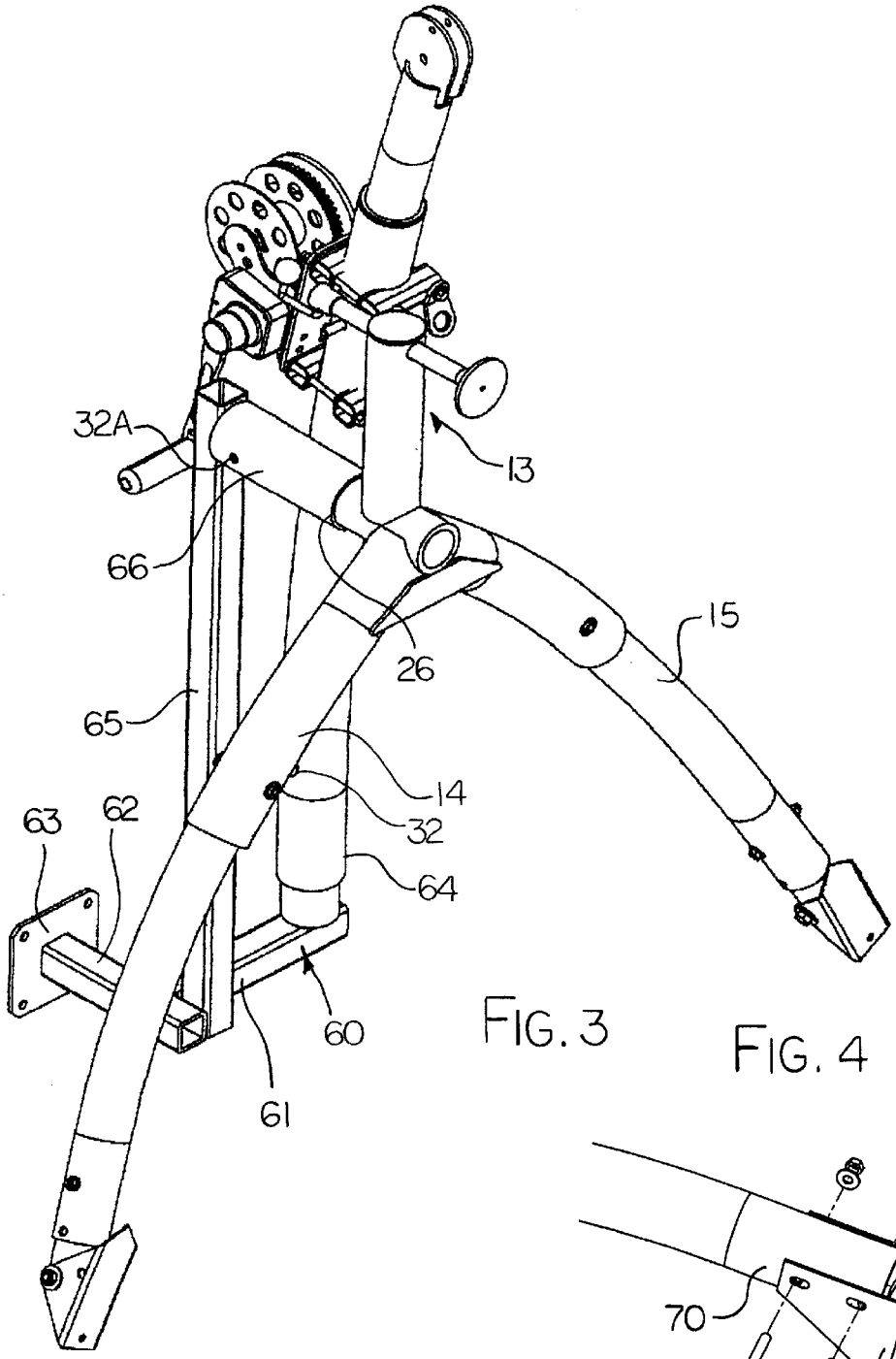
FIG. 3
FIG. 4
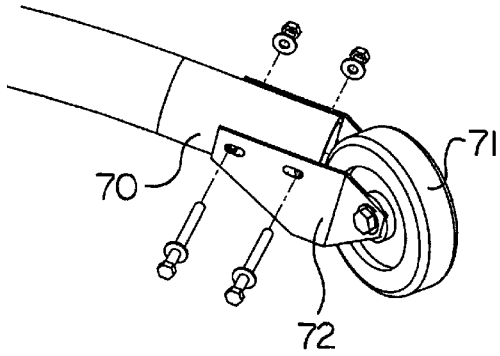

HOIST WITH CURVED FRAME MEMBERS

The present invention relates a hoist for mounting on a support surface such as the ground for lifting a load in a direction generally at right angles to the support surface.

BACKGROUND OF THE INVENTION

Many different designs of hoist are available for mounting in different locations and including different features for different end uses. The present invention is primarily but not exclusively concerned with safety systems by which an operator can enter through a manhole into a tank or pipe for investigation or service. Current regulations require that the operator be attached to a hoist so that in the event any injury or incapacitation, the operator can be returned to the surface by operation of the hoist.

A number of different designs of hoist of this type have been proposed where a base is located on the ground with legs surrounding the entrance hole and a jib portion extending from the base to an upper end where there is provided a cable guide which allows the cable to extend downwardly between the legs into the entrance so that the cable can pass into the underground area through the hole without dragging on the side of the hole. A manually operable winch is conventionally located on the jib portion so that it can be operated to winch the person back to the surface as required.

It is highly desirable that a device of this type be readily portable and therefore light weight is desirable. Often therefore the device is manufactured from aluminum but this is more difficult to weld. In addition it is desirable to manufacture the product simply from a relatively small number of parts which are easily manufactured and assembled to provide the lightweight construction at low cost.

SUMMARY OF THE INVENTION

In view of the foregoing, it is an object of the present invention to provide an improved hoist which can be manufactured simply and inexpensively from simple parts of a limited number thus allowing an economic pricing of the hoist.

According to a first aspect of the invention there is provided a hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body extending substantially from the bottom end to the upper end which is smoothly curved with a constant radius of curvature.

Preferably the tubular body is formed in two pieces where one piece has an end slidable into an end of the other so as to adjust a length of the body, with each piece being curved to the same radius of curvature. One piece, preferably the upper piece is of smaller diameter so as to slide inside the other.

Preferably the tubular body has end portions at the bottom end and the upper end which are straight, that is they have no bend following the same radius as the remained to the body. In an arrangement where the body is made in two pieces, each is bent fully up to the overlapping end so that each follows the same curvature, but each is straight at its opposite end.

Preferably the length of the straight portions is less than 10 inches and more preferably of the order of 5 inches so that the curvature extends along as much as possible of the jib portion but leaves the straight end portions for connection to the elements at the respective end without the necessity for accommodating a curvature at the ends. Thus, the bottom coupling is arranged at the bottom straight portion and the cable guide member is arranged at the upper straight portion.

Preferably the base member includes a vertical post portion onto which the bottom coupling is engaged so that this is preferably straight and vertical to match the bottom of the jib portion.

Preferably the winch mounting is on the jib portion at a position above the bottom coupling and preferably below the overlapping join between the two parts.

Preferably the base member includes two horizontal legs each extending outwardly from the attachment portion and defining therebetween a generally V-shape, each of the legs being formed by a tubular leg body extending substantially from an inner end at the attachment portion to an outer end which is smoothly curved with a constant radius of curvature Preferably each tubular leg body is formed in two pieces where one piece has an end slidable into an end of the other so as to adjust a length of the body, with each piece being curved to the same radius of curvature.

Preferably each tubular leg body has end portions at the inner end and the outer end which are straight so that the overlapping ends are curved at the common curvature. Thus, the inner end of each leg portion is engaged onto a respective one of two straight stub members of the attachment portion and the straight outer end is engaged onto a ground engaging element for supporting the base member.

The ground engaging element may comprise a pivotal foot simply for resting on the ground or it may comprise a wheel for rolling the structure over the ground to a location of use such as at a manhole.

Preferably the base member is generally Y-shaped in plan so as to define a horizontal rear leg portion extending generally opposite to the legs. The rear leg portion may includes, at an end remote from the jib portion, a ground engaging element for supporting the base member which comprises an adjustable leg for adjusting a height of the rear leg portion relative to a support surface for levelling the base member on the support surface relative to the feet or to the wheels.

Preferably the bottom coupling of the jib portion is separable from the attachment portion of the base member for separating the jib portion from the base member. In this arrangement, the apparatus may include a transportation bracket for carrying the separated jib portion and the separated base member. Such a bracket may include a first support member for receiving the bottom coupling of the jib portion and arranged to support the jib portion in a plane standing generally upwardly from the bracket and the bracket including a second support member for receiving the attachment portion of the base member and arranged to support the base member with the base plane generally parallel to the plane of the jib portion.

BRIEF DESCRIPTION OF THE DRAWINGS

On embodiment of the invention will now be described in conjunction with the accompanying drawings in which:

FIG. 3 is an isometric view of the hoist of FIG. 1 shown in a separated transport position and carried on a transport bracket for attachment to the hitch of a transport vehicle.

FIG. 4 is a scrap view of one end of one of the legs showing an alternate ground engaging element in the form of a wheel.

DETAILED DESCRIPTION

Figure 1:
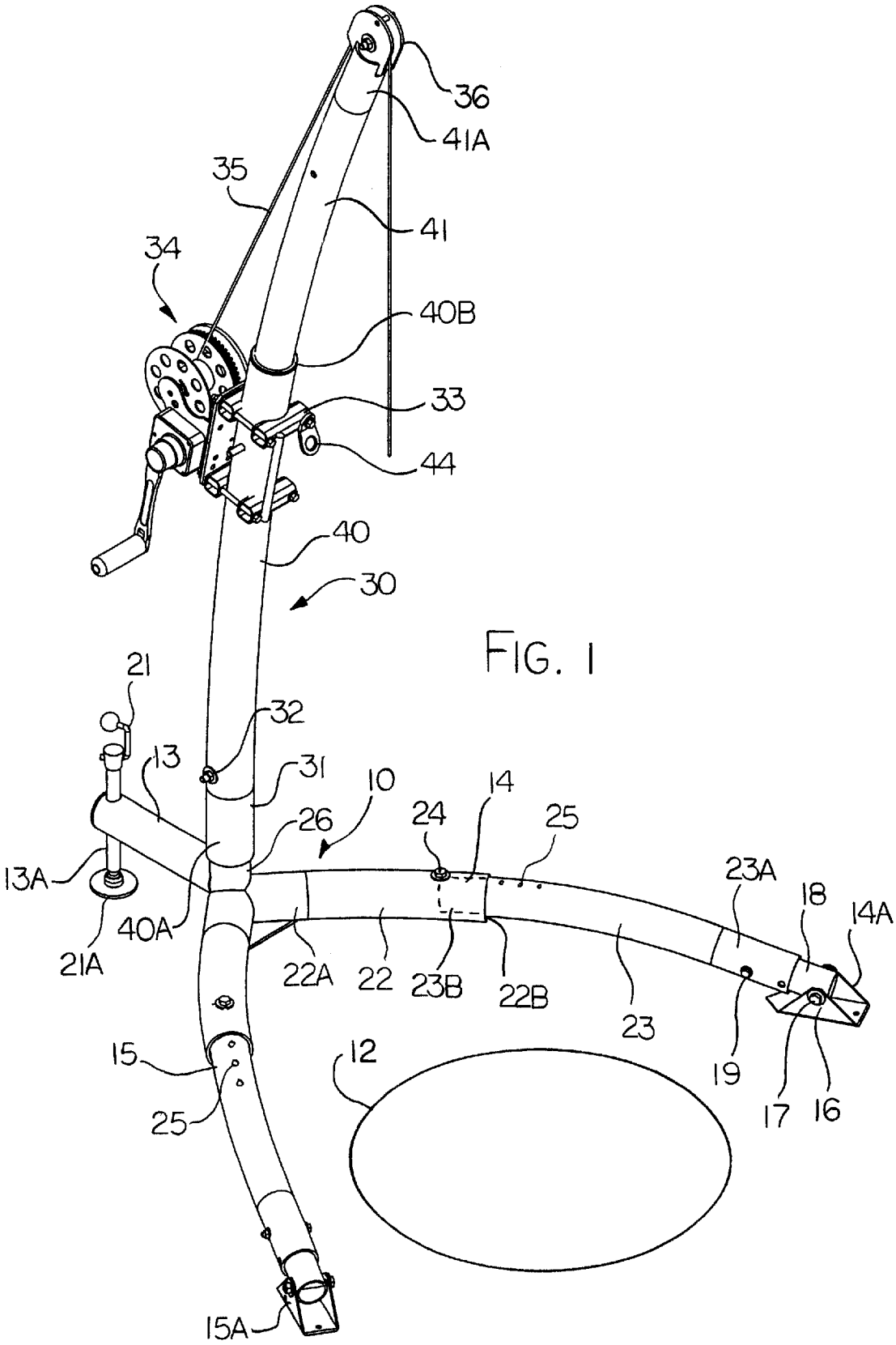
FIG. 1 is an isometric view of a hoist according to the present invention.
Figure 2:
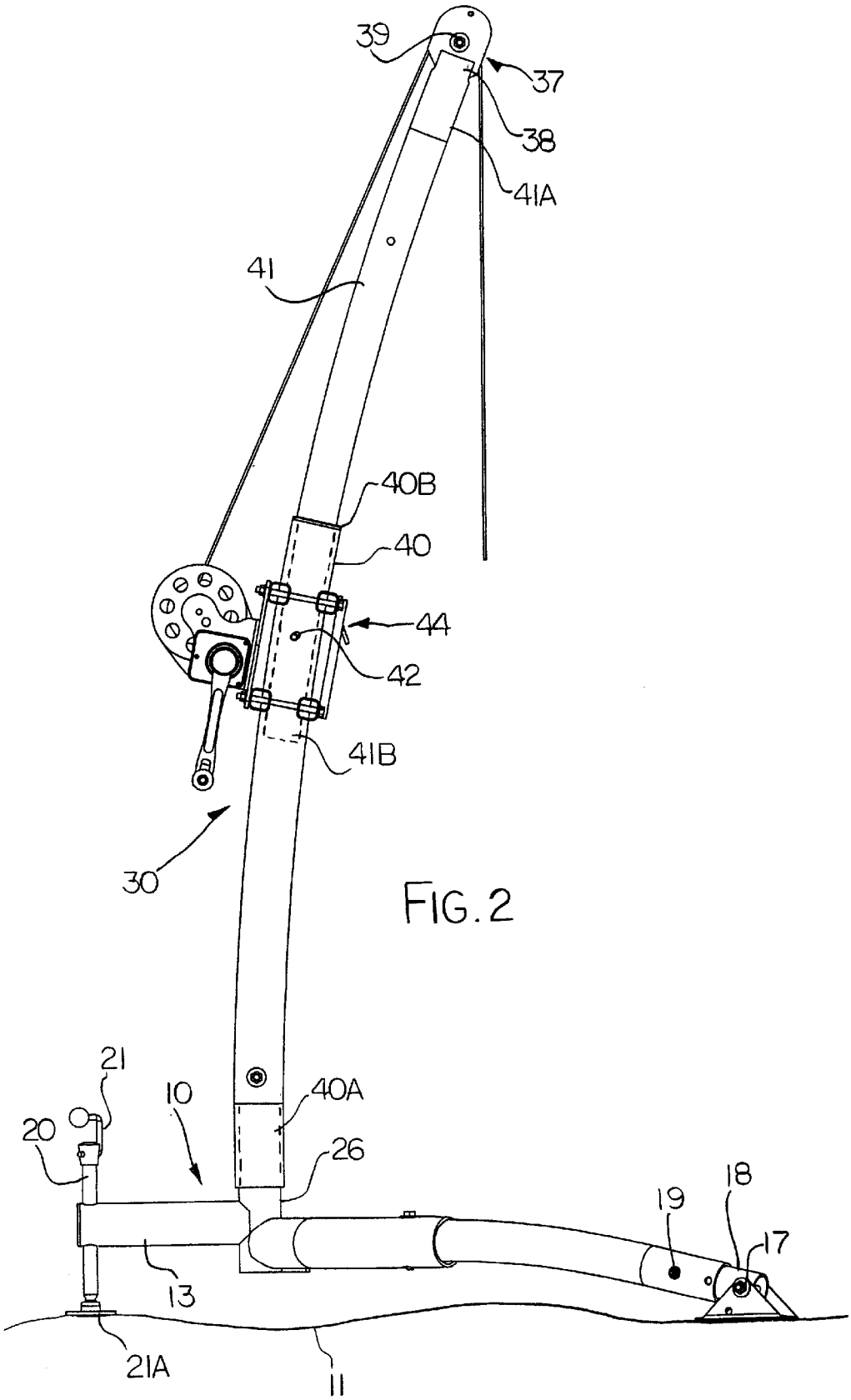
FIG. 2 is a cross sectional view of the hoist of FIG. 1.

The embodiment shown in the drawings comprises a base 10 for mounting on the ground 11 adjacent an entrance hole 12. The base 10 includes a rear leg portion 13 and two front leg portions 14 and 15 thus forming a generally Y-shaped structure with the two front legs spanning the opening 12 and the rear leg extending away from the hole so as to provide stability . At the end of each of the leg portions is provided a ground engaging member 13A, 14A, 15A which is arranged to provide a foot pad for sitting in stable manner on the ground so that the base is supported on the ground in a generally horizontal plane parallel to the ground.

Various designs of ground engaging element can be used but in the embodiment shown the elements 14A and 15A comprise a swivel pad 16 forming a horizontal base plate with two sides which pivot on a transverse pin 17. The foot pads are mounted on a stub shaft 18 which engages into and end portion of the respective leg and is held in place by a transverse pin 19. The foot pad 16 is therefore fixed in height relative to the leg and simply provides a flat base which can swivel to accommodate uneven terrain. The element 13A on the leg 13 comprises a screw jack 20 with a manually operable handle 21 and a pivotal foot pad 21A extending generally at right angles to the length of the screw jack. Operation of the jack 20 therefore can raise and lower the rear leg 13 to effect a levelling action of the base to place it in a horizontal plane while accommodating for uneven terrain.

The leg 13 is formed in a single piece from a tubular member. The legs 14 and 15 are formed in two pieces including an inner piece 22 and an outer piece 23 each of which is tubular in construction with the outer piece slidable inside the inner piece where it can be located by a pin 24 with the length of the leg being adjustable by selecting one of a plurality of holes 25 so that the position of the outer piece within the inner piece is adjusted. The tubular leg 13, the tubular inner piece 22 of the leg 14 and the tubular inner piece 22 of the leg 15 are all welded to a tubular stub post portion 26 which stands vertically upwardly at the junction between the legs. The post is thus vertical and the legs lie in a horizontal plane so that they stand at right angles to the post with an angle of the order of 60 to 90 degrees between the legs 14 and 15 and the leg 13 extending rearwardly and symmetrically between the legs 14 and 15.

The hoist further includes a jib portion 30 which has a lower end 31 mounted on the stub post 26. The jib portion is tubular so that it slips over the outside of the post 26 and is locked in place by a pin 32. The jib portion includes a mounting bracket 33 for receiving a winch 34 which is manually operable to pay out and draw in a cable 35. The winch itself is not part of the hoist structure and is a separate removable element so that it can be replaced by other forms of winch as required by the operator. At the upper end of the jib portion is provided a cable guide 36 so the cable 35 from the winch can pass over the cable guide and downwardly from the upper end of the jib portion into the opening 12. The cable guide comprises a pulley 37 mounted for rotation on a pin 39 carried between two support plates 38 attached to the upper end of the jib portion.

Similar to the structure of the legs, the jib portion is divided into two tubular pieces 40 and 41 where the piece 41 is a sliding fit inside the piece 40 so that the lower end of the piece 41 can slide into the upper end of the piece 40 to be locked in place by a pin 42. The bracket 33 is located at the upper end of the lower piece 40 and the shape and arrangement of the bracket can vary in accordance with the requirements depending upon the structure and mounting system of the winch. The bracket can include an attachment loop 44 by which a forward restraint anchor can be attached if required do that the person entering the opening in the event of a fall is prevented from dropping to the bottom of the underground area by is instead caught on the fall restraint allowing that person to be winched back to the surface if necessary.

In order to manufacture the structure from simple elongate pieces, the jib and preferably also the front legs are formed from curved tubular pieces. Thus the lower piece 40 is formed from a curved tube of circular cross section to a radius of curvature of the order of INSERT feet. Similarly the upper piece which is formed from a tubular member of smaller diameter so as to be a sliding fit inside the lower piece is also curved to provide a radius of curvature exactly equalling that of the lower piece. The curvature of each piece is constant through a curved portion of the piece but end portions are straight and free from curvature. Thus the lower portion 40 has a straight portion 40A at its bottom end and is curved through to its upper end 40B. The upper portion 41 includes a straight portion 41A at its upper end and is curved through to its lower end 41B within the lower portion. As the curvature extends through to the overlapping sections of the upper end of the lower portion and the lower end of the upper portion, the sliding action can occur between the two portions since they are of the same radius of curvature.

The straight portions 40A and 41A where the tubular member is not curved are kept as short as possible so as to be less than 10 inches in length and preferable of the order of 5 inches in length.

Each of the two portions 40 and 41 is formed separately on a conventional roller bending system. Thus the portion 40 is formed out of one half of a piece of the tubular material which is passed through the bending system. The complete tubular piece thus necessarily has end portions which are not curved due to the nature of a roller bending system as well known to one skilled in the art. The roller bending system is arranged so that the straight sections at the end of the tubular piece so formed are as short as possible as set forth above. In order to complete the manufacture of the portion 40, therefore, the complete tube piece with straight portions at each end is cut in half so that each half forms the tubular portion 40 of one hoist. The whole of the material of the tubular piece is then used in the manufacture since the relatively short straight section is used at the bottom of the portion 40 and the continuously curved center section of the tubular member defines the upper end 40A.

The upper portion 41 is similarly formed from a tubular piece of the required diameter with the tubular member used in the manufacture being selected so that it has a length twice the length of the required upper portion 41.

The legs 14 and 15 are formed in the same way so the inner portion 22 has a straight portion 22*a* and it is curved at a constant radius to its outer end 22B. the outer portion 23 has a straight section 23A at its outer end and is continuously curved to its inner end 23B. the legs are formed similarly from a single piece of the tubular material of the required length which is cut in half so that one half forms the inner portion 22 at one leg and the other half forms the inner portion of the other leg. Similarly the outer portions are formed from one half of a tubular member of the required smaller diameter and the required length.

The curvature of the jib portion automatically locates the upper end of the jib portion upwardly and forwardly of the post 26 so that the cable guide is located between the legs at a position where the cable can extend downwardly into the opening 12. Similarly the curvature of the legs wraps the legs partly around the opening 12 so as to provide stability and so as to reduce the transverse dimension of the structure.

In FIG. 3 is shown a bracket for transporting the hoist. The bracket 60 comprises a horizontal beam 61 attached to the forwardly extending horizontal beam 62 with a mounting plate 63 at its forward end for attachment to the hitch of a transportation vehicle. Thus the bracket is mounted on the rear of the vehicle outside of the normal load capacity of the vehicle thus supporting the hitch on the rear of the vehicle. The beam 61 carries a post portion 64 which simulates the post portion 26 and stands upwardly therefrom.

With the pin 32 pulled from the hoist structure, the jib portion can be separated from the base by pulling the lower portion 40 upwardly from the post 26 whereupon the lower portion 40 can be applied onto the post 64 and the pin 32 replaced to hold the jib portion in position on the bracket. The jib portion is oriented so that it lies in a plane parallel to the beam 61 so that its upper end projects outwardly beyond one end of the beam 61. The beam 61 lies transverse to the vehicle and therefore the jib portion lies across the rear of the vehicle. When the upper portion 41 is retracted inside the lower portion 40 of the jib portion, the upper end can be located at a position suitably within the dimensions of the vehicle.

At the other end of the beam 61 is provided a post 65 which stands upwardly alongside the jib portion. At the upper end of the post 65 is provided a sleeve 66 which simulates the open end of the lower portion 40 of the jib portion so that the post 26 of the base can slide into place inside the sleeve 66 and be locked in place by an additional pin 32A. Thus the plane of the base is now moved into a vertical orientation with the leg 13 standing upwardly and the two legs 14 and 15 hanging downwardly. The location of the sleeve 66 is arranged so that the base is supported in a plane just rearward of the jib portion and parallel thereto. Again the curvature of the legs is suitable to maintain the base structure within the confines of the vehicle. In this way therefor the hoist can be located on the vehicle for ready assembly and use without interfering with the normal load capacity of the vehicle.

In FIG. 4 is shown a simple replacement for the foot pad 16 which comprises a stub portion 70 carrying a ground wheel 71 on two side plates 72 so that the stub portion 70 can be inserted into the outer end of the leg in replacement for the foot pad 16 and its stub portion 18. This allows the base to be rolled across the ground by manually lifting the base at the leg 13 so that the hoist can be moved into place by rolling forwardly until the legs span the opening to be accessed.

The construction described above allows the manufacture of a hoist for use at an entrance hole which is of lightweight aluminum construction which can weigh as little as 31 Kg (67 lbs.). The foot pads can provide no-slip rubber foot pads which conform to the working surface or can be replaced by the roller wheels. The single screw jack 20 provides a single adjustment for levelling and the mast offset, that is the location of the upper end relative to the base, can be adjusted simply by raising and lowering the upper portion of the mast. The jib portion can be mounted on a bolted support structure in replacement for the base frame. Thus where repeated use of the hoist is required at a specific location, a base member can be bolted onto the structure at the required location and defining an upwardly standing sleeve. An adapter portion in the form of a tubular post is then inserted into the sleeve and simulates the post 26 of the base. The bottom end of the jib portion is then connected to the insert and the insert can rotate within the sleeve so the jib portion can rotate side to side.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

What is claimed is:

1. A hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body of constant cross-section extending substantially from the bottom end to the upper end which tubular body is along substantially its full length from the bottom end at the bottom coupling to the upper end at the cable guide member smoothly curved with a constant radius of curvature.

2. The hoist according to claim 1 wherein the tubular body has end portions at the bottom end and the upper end which are straight and wherein the length of the straight portions is less than 10 inches.

3. A hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body of constant cross-section extending substantially from the bottom end to the upper end which tubular body is along substantially its full length from the bottom end at the bottom coupling to the upper end at the cable guide member smoothly curved with a constant radius of curvature wherein the tubular body is formed in two pieces where one piece has an end slidable into an end of the other so as to adjust a length of the body, with each piece being smoothly curved to the same radius of curvature.

4. The hoist according to claim 3 wherein the tubular body has end portions at the bottom end and the upper end which are straight and wherein the length of the straight portions is less than 10 inches.

5. A hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body of constant cross-section extending substantially from the bottom end to the upper end which tubular body is long substantially its full length from the bottom end at the bottom coupling to the upper end at the cable guide member smoothly curved with a constant radius of curvature;

wherein the base member includes two horizontal legs each extending outwardly from the attachment portion and defining therebetween a generally V-shape;

and wherein each of the legs is formed by a tubular leg body of constant cross-section extending substantially from an inner end at the attachment portion to an outer end which tubular leg body is along substantially its full length from the attachment portion to an outer end of the tubular leg body smoothly curved with a constant radius of curvature.

6. The hoist according to claim 5 wherein each tubular leg body is formed in two pieces where one piece has an end slidable into an end of the other so as to adjust a length of the body, with each piece being curved to the same radius of curvature.

7. The hoist according to claim 5 wherein each tubular leg body has end portions at the inner end and the outer end which are straight.

8. The hoist according to claim 7 wherein the inner end of each leg portion is engaged onto a respective one of two straight stub members of the attachment portion.

9. The hoist according to claim 7 wherein the straight outer end is engaged onto a ground engaging element for supporting the base member.

10. The hoist according to claim 9 wherein the ground engaging element comprises a pivotal foot.

11. The hoist according to claim 9 wherein the ground engaging element comprises a wheel.

12. The hoist according to claim 5 wherein the tubular body has end portions at the bottom end and the upper end which are straight and wherein the length of the straight portions is less than 10 inches.

13. The hoist according to claim 5 wherein the tubular body forming the jib portion is formed in two pieces where one piece has an end slidable into an end of the other so as to adjust a length of the body, with each piece being smoothly curved to the same radius of curvature.

14. A hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body extending substantially from the bottom end to the upper end which is smoothly curved with a constant radius of curvature;

wherein the bottom coupling of the jib portion is separable from the attachment portion of the base member for separating the jib portion from the base member;

wherein the base member defines a base plane which in use is generally parallel to the support surface;

and wherein there is provided a transportation bracket for carrying the separated jib portion and the separated base member, the bracket including a first support member for receiving the bottom coupling of the jib portion and arranged to support the jib portion in a plane standing generally upwardly from the bracket and the bracket including a second support member for receiving the attachment portion of the base member and arranged to support the base member with the base plane generally parallel to the plane of the jib portion.

15. The hoist according to claim 14 wherein the tubular body forming the jib portion is of constant cross-section and is along substantially its full length from the bottom end at the bottom coupling to the upper end at the cable guide member smoothly curved with a constant radius of curvature.

16. The hoist according to claim 15 wherein the tubular body forming the jib portion is formed in two pieces where one piece has an end slidable into an end of the other so as to adjust a length of the body, with each piece being smoothly curved to the same radius of curvature.

17. The hoist according to claim 14 wherein the tubular body has end portions at the bottom end and the upper end which are straight and wherein the length of the straight portions is less than 10 inches.

18. A hoist for mounting on a support surface for lifting a load in a direction generally at right angles to the support surface, the hoist comprising:

a base member for mounting on the support surface;

a jib portion;

the jib portion having a bottom coupling at a bottom end for attachment to an attachment portion of the base member such that the jib portion is supported thereby;

and a winch mounting for receiving thereon a winch for paying out and drawing in a cable;

the jib portion having a cable guide member at an upper end over which the cable can pass to be guided from the winch over the cable guide member downwardly from the upper end of the jib portion for attachment to a load to be lifted;

the jib portion being shaped such that the upper end is located upwardly from and forwardly of the bottom coupling such that, with the bottom coupling located by the base member on the support structure behind a load to be lifted, the upper end is located above the load to be lifted;

the jib portion being formed by a tubular body extending substantially from the bottom end to the upper end which is smoothly curved with a constant radius of curvature;

wherein the bottom coupling of the jib portion is separable from the attachment portion of the base member for separating the jib portion from the base member;

and wherein there is provided a transportation bracket for carrying the separated jib portion and the separated base member, the bracket including a mounting portion for attachment to a hitch of a transportation vehicle such that the bracket and the hoist are carried on the hitch.

19. The hoist according to claim 18 wherein the tubular body forming the jib portion is of constant cross-section and is along substantially its full length from the bottom end at the bottom coupling to the upper end at the cable guide member smoothly curved with a constant radius of curvature.

20. The hoist according to claim 19 wherein the tubular body forming the jib portion is formed in two pieces where one piece has an end slidable into an end of the other so as to adjust a length of the body, with each piece being smoothly curved to the same radius of curvature.

21. The hoist according to claim 18 wherein the tubular body has end portions at the bottom end and the upper end which are straight and wherein the length.

* * * * *